United States Patent [19]

Long

[11] Patent Number: 5,009,087

[45] Date of Patent: Apr. 23, 1991

[54] LOCK DEVICE WITH RETAINING CABLE

[76] Inventor: Royal B. Long, P.O. Box 66, Houston, Tex. 77001

[21] Appl. No.: 569,841

[22] Filed: Aug. 20, 1990

[51] Int. Cl.[5] ..... E05B 67/06

[52] U.S. Cl. ..... 70/49; 70/38 A; 70/51

[58] Field of Search ..... 70/49, 30, 38 R–38 C, 70/51

[56] References Cited

U.S. PATENT DOCUMENTS

| | | | |
|---|---|---|---|
| 834,027 | 10/1906 | Slaymaker | 70/38 C |
| 1,386,778 | 8/1921 | Gray | 70/49 |
| 1,609,817 | 12/1926 | Hanton | 70/49 X |
| 1,845,354 | 2/1932 | Soref | 70/49 X |
| 3,605,458 | 9/1971 | Best | 70/49 |
| 3,754,419 | 8/1973 | Taylor | 70/38 A X |
| 4,226,100 | 10/1980 | Hampton et al. | 70/51 |
| 4,419,873 | 12/1983 | Sopko | 70/38 A |

FOREIGN PATENT DOCUMENTS

| | | | |
|---|---|---|---|
| 865398 | 3/1971 | Canada | 70/51 |
| 617978 | 2/1949 | United Kingdom | 70/49 |

*Primary Examiner*—Gary L. Smith
*Assistant Examiner*—Suzanne L. Dino
*Attorney, Agent, or Firm*—Kenneth A. Roddy

[57] ABSTRACT

A lock device in the form of a padlock has a shackle and a retaining cable connected to the lock case. The shackle has a heel-piece permanently retained slidably and rotatably in the case of the padlock and is urged upwardly in the unlocked position by a spring. The retainer cable has a yoke at one end which is received in a slot in the side of the lock case and captured within the case by the lower portion of the shackle which slides up and down through the yoke as the shackle is moved up and down between the locked and unlocked positions. The free end of the retaining cable may be secured to a convenient structure in close proximity to where the lock will be used to maintain the lock at the use location whereby the lock may be secured at the use location either in its locked or unlocked condition. After the padlock has been unlocked by a key, the shackle can be rotated and can be installed on or removed from the article to be secured by the lock, but the retaining cable yoke is still locked within the lock case by the lower portion of the shackle heel-piece. When the key is reinserted and turned, the shackle is turned 180 degrees and pushed to the complete down position to align a flat portion of the heel-piece with a slot in the yoke and the yoke can be pulled out of the padlock case. A color-coding system may also be provided to identify corresponding keys, locks, and retainer cables.

19 Claims, 3 Drawing Sheets

LOCK DEVICE WITH RETAINING CABLE

BACKGROUND OF THE INVENTION

1. Field of the Invention

This invention relates generally to locking devices, and more particularly to a lock device having a shackle and a retaining cable releasably secured to the lock case to secure the lock device at the use location whether the shackle is in a locked or unlocked condition.

2. Brief Description of the Prior Art

It is common practice to secure articles with lock devices having a shackle. It is also common practice to wrap a chain around the article to be secured and pas the shackle through links at the free ends of the chain.

Often it may be necessary to leave a lock in the unlocked condition in order to allow someone without a key to enter the secured area or until such time as it is necessary to re-lock the article to be secured.

One of the major problems with conventional locking devices is that once the shackle of the lock has been opened, the lock can easily be lost, misplaced, stolen, or otherwise removed from the location at which the lock is to be used.

It would therefore be desirable to provide a locking device having a shackle and a retaining cable secured to the case of the lock to allow the lock to be retained at the use location whether the shackle is in a locked or unlocked condition and to prevent the lock from being lost or stolen.

There are several patents which disclose locking devices having various shackle, chain, and cable attachments.

Gray, U.S. Pat. No. 1,386,778 discloses a locking device having a shackle in the form of a link chain. One end of the link chain is permanently secured to one end of the lock body and its free end is connected and disconnected from the other end of the lock body by the locking and unlocking of the lock.

Soref, U.S. Pat. No. 1,845,354 discloses a locking device having a U-shaped shackle permanently secured to the lock body and a link chain having a link at one end permanently captured by the shackle and a T-shaped head at the free end of the chain. The T-shaped head is connected and disconnected from the shackle by the locking and unlocking of the lock with a key.

Hanton, U.S. Pat. No. 1,609,817 discloses a padlock having a yoke-shaped shackle pivoted at one side to the lock body and a link chain having a link at one end permanently captured by the shackle and a link at the free end of the chain releasably captured by the shackle such that the two ends of the chain are locked together.

Best, U.S. Pat. No. 3,605,458 discloses a padlock having a shackle in the form of a flexible cable. The cable heel piece is permanently but rotatably secured in the lock body with a shackle plug which is inserted with the heel piece from the rear and then turned to bayonet locked engagement with lugs within the lock body. The cable toe piece is releasably secured with a sliding bolt.

The present invention is distinguished over the prior art in general, and these patents in particular by a lock device having a shackle and a retaining cable secured to the lock case. The shackle has a heel-piece which is permanently retained slidably and rotatably in the case of the lock device and is urged upwardly in the unlocked position by a spring. The retainer cable has a yoke at one end which is received in a slot in the side of the lock case and captured within the case by the lower portion of the shackle which slides up and down through the yoke as the shackle is moved up and down between the locked and unlocked positions. The free end of the retaining cable may be secured to a convenient structure in close proximity to where the lock will be used to maintain the lock at the use location whereby the lock may be secured at the use location either in its locked or unlocked condition. After the lock has been unlocked by a key, the shackle can be rotated and can be installed on or removed from the article to be secured by the lock, but the retaining cable yoke is still locked within the lock case by the lower portion of the shackle heel-piece. When the key is reinserted and turned, the shackle is turned 180 degrees and pushed to the complete down position to align a flat portion of the heel-piece with a slot in the yoke and the yoke can be pulled out of the lock case. A color-coding system may also be provided to identify corresponding keys, locks, and retainer cables.

SUMMARY OF THE INVENTION

It is therefore an object of the present invention to provide a lock device having a shackle and a retaining cable releasably secured to the lock case such that the lock is selectively retained at the use location to prevent unauthorized or accidental removal of the lock from the desired use location.

It is another object of this invention to provide a lock device which has a retaining cable secured to the lock case for retaining the lock at the use location whether the lock shackle is in a locked or unlocked condition.

Another object of this invention is to provide a lock device having a retaining cable secured to the lock case in which the components are color-coded to quickly and easily identify corresponding keys, locks, and retaining cables.

Another object of this invention is to provide a lock device having a case with surrounding colored resilient band which will serve as a color coding member and as a resilient bumper to prevent the lock case from damaging the surface upon which it is locked or retained by the retaining cable.

A further object of this invention is to provide a lock device which is simple in construction, economical to manufacture, and rugged and durable in use.

Other objects of the invention will become apparent from time to time throughout the specification and claims as hereinafter related.

The above noted objects and other objects of the invention are accomplished by a lock device having a shackle and a retaining cable secured to the lock case. The shackle has a heel-piece which is permanently retained slidably and rotatably in the case of the lock and is urged upwardly in the unlocked position by a spring. The retainer cable has a yoke at one end which is received in a slot in the side of the lock case and captured within the case by the lower portion of the shackle which slides up and down through the yoke a the shackle is moved up and down between the locked and unlocked positions. The free end of the retaining cable may be secured to a convenient structure in close proximity to where the lock will be used to maintain the lock at the use location whereby the lock may be secured at the use location either in its locked or unlocked condition. After the lock has been unlocked by a key, the shackle can be rotated and can be installed on or removed from the article to be secured by the lock, but the retaining cable yoke is still locked within the lock case by the lower portion of the shackle heel-piece. When the key is reinserted and turned, the shackle is turned 180 degrees and pushed to the complete down position to align a flat portion of the heel-piece with a slot in the yoke and the yoke can be pulled out of the lock case. A color-coding system may also be provided to identify corresponding keys, locks, and retainer cables.

DESCRIPTION OF THE PREFERRED EMBODIMENT

Figure 1:
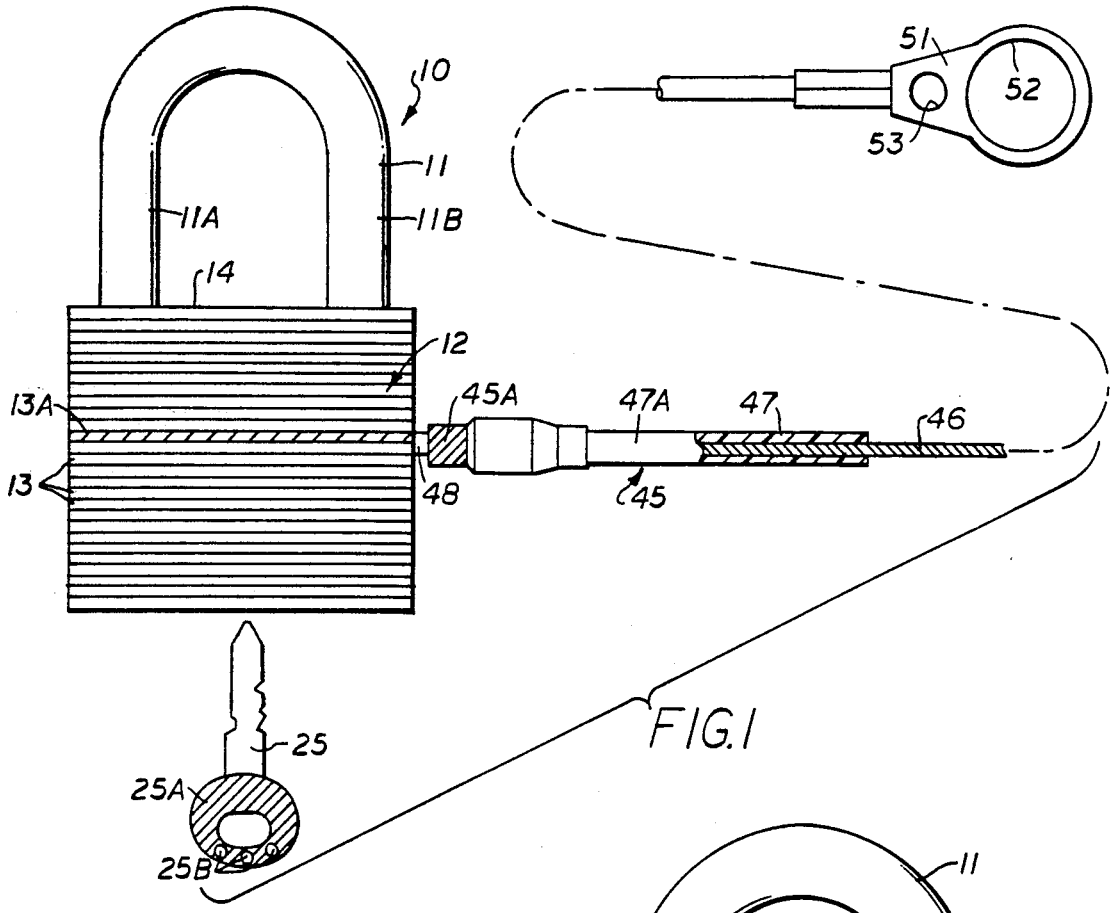
FIG. 1 is an elevation view of a preferred lock device with a retaining cable in accordance with the present invention.
Figure 2:
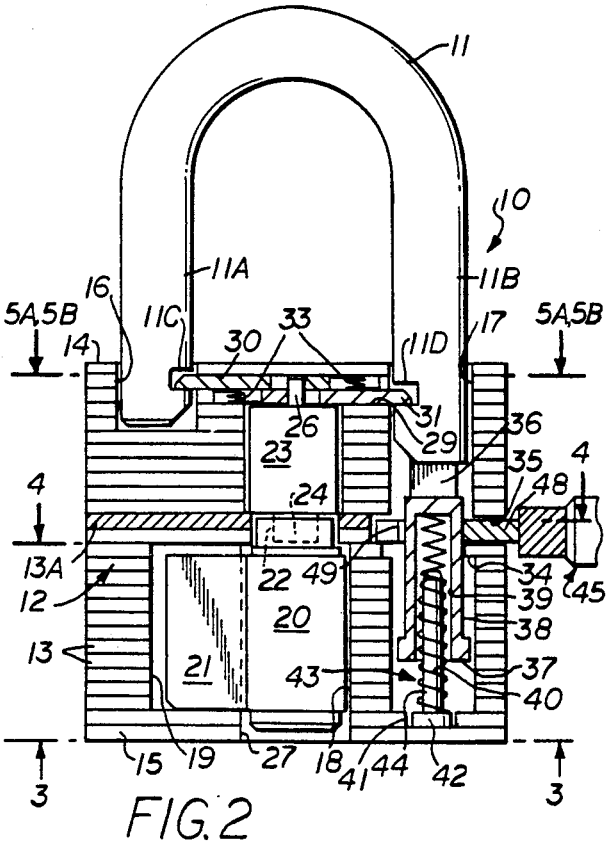
FIG. 2 is longitudinal cross section showing the lock device in the position.

Referring to the drawings by numerals of reference, there is shown in FIGS. 1 and 2, a preferred lock device in the form of a padlock 10 having a shackle 11 and a lanyard keeper or retaining cable 45 releasably secured to the body or case of the lock. The lock device or padlock 10 comprises a body or case 12 preferably formed of a plurality of thin rectangular metal plates or leaves 13 which are stacked in layers and secured together by conventional means such as rivets. The layered plate construction of the lock case is conventional and the leaves are die stamped or drilled to have apertures which form bores, etc., when the leaves are stacked. In the following discussion, body or case 12 is intended to comprise the plurality of leaves 13 secured together as a unit and the bores, etc. formed therein are actually created by holes in the individual leaves. The topmost leaf forms the top wall 14 of the body and the lowermost leaf forms the bottom wall 15. The individual leaves are not cross hatched to avoid confusion.

The case 12 has laterally spaced bores 16 and 17 extending inwardly from its top wall 14 to receive the toe-piece 11A and heel-piece 11B, respectively, of the U-shaped shackle 11 (FIG. 2). A bore 18 extends inwardly from the bottom wall 15 and is enclosed by the top leaf 14. A rectangular cavity 19 extends laterally from the bore 18.

Figure 3:
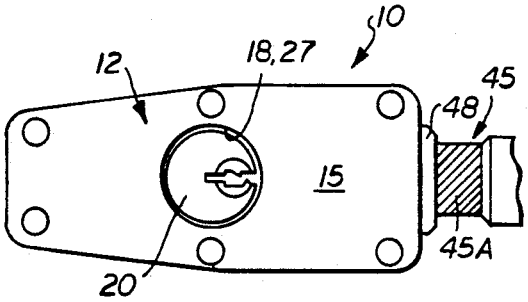
FIG. 3 is a bottom view of the lock device.
Figure 4:
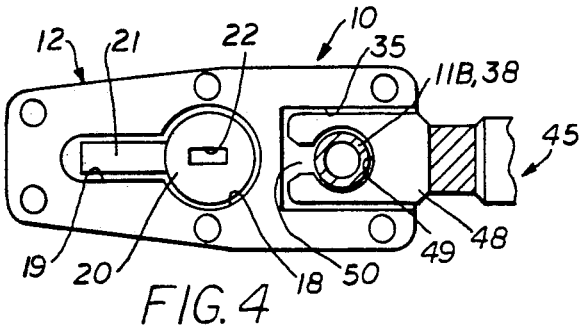
FIG. 4 is transverse cross section through lock case along line 4—4 of FIG. 2 showing the lock cylinder and the yoke portion of the retaining cable secured on the shackle heel-piece.

Referring additionally to FIGS. 3 and 4, a cylindrical key cylinder assembly 20 is received in the bore 18 and has a rectangular tongue 21 extending laterally from one side which is received in the rectangular cavity 19 to secure the cylinder assembly 20 against rotation. The internal rotating mechanism of the cylinder assembly 20 is conventional and has a slot 22 at the top portion. A cylindrical spacer member 23 is rotatably received in the bore 18 and has a tongue 24 depending from its bottom end which is engaged in the slot 22. The spacer 23 is thus fixed at its bottom end to the internal rotating mechanism of the key cylinder assembly 20 and is rotated by inserting a key 25 into the key cylinder 20 and turning it. A second tongue 26 extends from the top of the spacer 23. The lowermost leaf forming the bottom wall 15 encloses the bottom of the rectangular cavity 19 and is provided with a bore 27 in axial alignment with the bore 18 and cylinder 20 to receive the key 25 (FIGS. 1, 2, and 3).

Figure 5A:
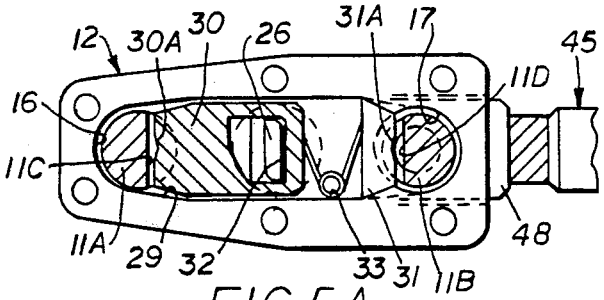
FIG. 5A is transverse cross section through the shackle release portion taken along line 5A—5A of FIG. 2 showing the yoke portion of the retaining cable received thereon.
Figure 5B:
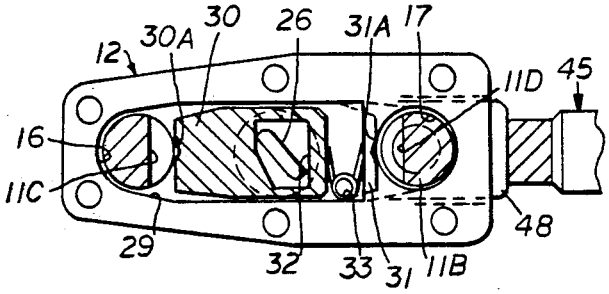
FIG. 5B is transverse cross section through the shackle slide portion taken along line 5B—5B of FIG. 2 showing the yoke portion of the retaining cable received thereon.

As seen in FIGS. 2, 5A and 5B, the leaves just beneath the top wall 14 are provided with a slot 29 extending laterally from the bore 18 to the bores 16 and 17. A pair of locking plates 30 and 31 are slidably received in the slot 29 in stacked opposed relation. Each locking plate has an aperture 32 near its inner end which is received on the tongue 26 extending from the top of the spacer 23. The aperture 32 is configured to provide a camming surface whereby the locking plates 30 and 31 are moved by the tongue 26 in opposed relation between a laterally extended (locked) and retracted (unlocked) position upon rotation of the spacer 23. In the outwardly extended or locked position (FIG. 5A), the outward ends 30A and 31A of the locking plates 30 and 31 protrude into the bores 16 and 17 respectively. In the retracted or unlocked position (FIG. 5B), the outward ends 30A and 31A of the plates are retracted from the bores 16 and 17. The locking plates are urged normally outward by a pair of small coil springs 33 disposed in the slots 29 which have their free ends compressed between the inward ends of the plates 30 and 31 and the back wall of the slots 29.

As seen in FIG. 2, a leaf approximately midway between the top and bottom walls 14 and 15 is provided with an offset to form a stop shoulder 34 in the bore 17. A short distance above the stop shoulder 34, a pair of the leaves are provided with a cut-out portion to define a slot 35 extending laterally from the bore 17 to the exterior of the lock body (FIGS. 2 and 4).

Figure 6:
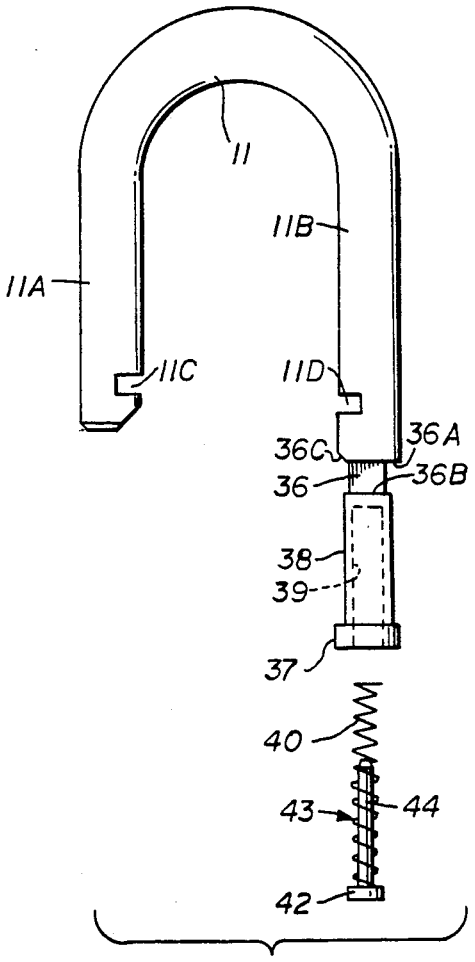
FIG. 6 is an elevation of the shackle assembly of the lock device.

Referring additionally to FIG. 6, the upper portion of the U-shaped shackle 11 is curved to form two legs, the shorter of which is the toe-piece 11A and the longer of which is the heel-piece 11B. Laterally opposed notches 11C and 11D are provided in the toe-piece and heel-piece. The heel-piece 11B has a short flat portion or release portion 36 a short distance below the notch 11D defining upper and lower annular shoulders 36A and 36B at the top and bottom ends of the flat release portion 36.

The upper shoulder 36A has a tapered surface 36C extending angularly upward and outward from the flat release portion 36 on the interior side of the heel-piece. The configuration of the tapered surface 36C and shoulder 36A is such that the shackle 11 will be prevented from moving downward past the locking plate 31 when it is rotated 180 degrees and the locking plate has been extended by releasing the key 25. In other words, the shackle 11 can not be pushed down unless the key is inserted and turned to retract the locking plates 30 and 31, or unless the shackle is turned to position the toe-piece 11A in axial alignment with the bore 16.

The heel-piece 11B has a reduced diameter portion which extends downwardly from the flat release portion 36 and terminates in an enlarged diameter retainer portion 37 at its bottom end. The reduced diameter cylindrical portion of the heel-member 11B between the release portion 36 and the retainer portion 37 is referred to as the slide portion 38. A bore 39 extends upward a distance from the bottom of the heel-piece 11B to receive a small compression spring 40.

A leaf just above the bottom leaf 15 has an aperture 41 which receives the head 42 of a headed pin 43. The shank 44 of the headed pin 43 extends upward inside the spring 40 to serve as a spring guide. The spring 40 normally urges the shackle 11 upward.

Figure 8:
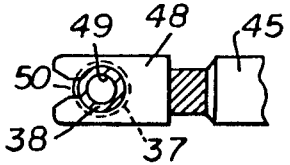
FIG. 8 is transverse cross section showing the retaining cable yoke maintained on the slide portion of the shackle heel-piece.

Referring again to FIGS. 1 and 2, and to FIG. 8, the retaining cable 45 is formed of flexible cable 46 and covered by a sheath 47 of protective weather resistant material. A flat yoke 48 is secured to one end of the cable 45. The yoke 48 has a central hole 49 and a narrow slot 50 which extends from the hole to the front end of the yoke to form projections at the open side of the hole. In the assembled condition, the yoke 48 is received in the slot 35 and the slide portion 38 of the shackle 11 extends through the hole 49 of the yoke 48 (FIGS. 4 and 8).

As explained hereinafter, the slot 50 of the yoke 48 is of sufficient width to slide laterally on and off of the flat release portion 37 of the shackle 11. The free end of the retaining cable 45 is provided with a plate 51 having an aperture 52 through which the yoke end 48 of the cable ma be passed to form a loop. A smaller hole or aperture 53 may also be provided in the plate 51 to receive a bolt (not shown) for securing the free end of the retaining cable to a convenient structure in close proximity to where the lock will be used.

As seen in FIG. 2, in the assembled condition, the heel-piece 11B of the shackle 11 is slidably and rotatably received in the bore 17 and is permanently retained in the bore 17 by the stop shoulder 34. The compression spring 40 urges the shackle 11 normally upward to engage the retainer portion 37 against stop shoulder 34. The yoke 48 of the retainer cable 45 is received in the slot 35 in the side of the lock case and only the slide portion 38 of the shackle 11 slides up and down through the yoke hole 49 as the shackle 11 is moved up and down between the locked and unlocked positions. Thus, one end of the retaining cable 45 is captured in the lock case during normal locking and unlocking operations.

The free end of the retaining cable 45 may be secured to a convenient structure in close proximity to where the lock will be used to maintain the lock at the use location whereby the lock may be secured at the use location either in its locked or unlocked condition without fear of the lock being lost or stolen. To accomplish this, the yoke 48 may be passed through the aperture 52 of the plate 51 to loop the cable onto a convenient structure, such as a chain-link fence, prior to inserting the yoke into the case 12. A bolt may also be installed through the smaller aperture 53 in the plate 51 to bolt the retaining cable 45 to a convenient structure in close proximity to where the lock will be used.

The combination of the lock device with the retaining cable also provides the basis for a color-coding system. As seen in FIGS. 1 and 2, one or more of the leaves 13A may be colored differently than the remainder of the leaves 13, for example red. This will give the case 12 of the lock 10 a distinctive colored stripe on the exterior. The retaining cable 45 would be provided with a colored sleeve 45A or a colored sheath 47A to match the colored stripe 13A of the lock case. The key 25 would also be provided with a colored sheath to match the stripe 13A and the sleeve 45A or sheath 47A of the cable 45.

In this manner, certain locks could always be attached to corresponding retaining cables at predetermined locations, making it easy to identify the proper key to use to operate each lock and where each lock should be located. This would be particularly useful in the event that several different locks with different combinations are used at various locations, such as on farms, ranches, industrial and commercial locations.

Keys 25 may also be provided with one or more different colored inserts 25B whereby certain keys would unlock one or more locks identified by a corresponding colored stripe 13A and/or colored retaining cable collar 45A or sheath 47A. For example, a key may have a red insert and a yellow insert which would indicate that that particular key would open both a lock having a red stripe and a lock having a yellow stripe.

Figure 12:
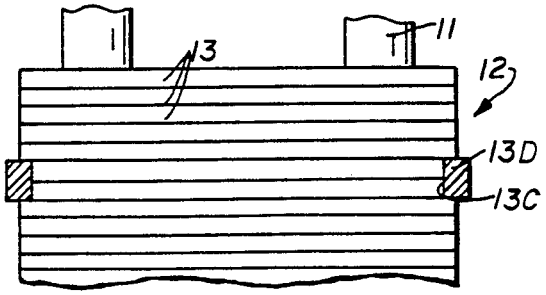
FIG. 12 shows a partial elevation view of the lock case having a surrounding colored resilient band.

FIG. 12 shows an alternative color coding method wherein one or more of the leaves 13 making up the lock case 12 have a smaller peripheral dimension than the remainder defining a peripheral recess or groove 13C surrounding the case. A colored band 13D of suitable material is installed in the groove 13C. The colored band 13D is preferably formed of resilient or elastomeric material and is of sufficient cross sectional width to form a raised band surrounding the case. In this manner, the band 13D additionally serves as a resilient bumper to prevent the lock case from damaging the surface upon which it is locked or retained by the retaining cable.

OPERATION

Referring now to FIGS. 2, 5A, 5B, and 7–11, the operation of the lock will be described. FIG. 2 shows the lock device 10 in the locked position. When locked, the springs 33 urge the locking plates 30 and 31 outward to engage the notches 11C and 11D in the toe-piece 11A and heel-piece 11B of the shackle 11. In this position the key can be removed and the retaining cable yoke 48 extending through the slot 35 of the lock case 12 is secured within the case of the lock by the shackle slide portion 38 passing through the yoke hole 49.

In the unlocked position (FIG. 7) the key 25 is inserted into the cylinder assembly 20 and is turned to rotate the spacer 23 and tongue 26 which retracts the locking plates 30 and 31. The shackle 11 is then urged upward by the spring 40. When the shackle heel-piece 11B moves up, the retainer portion 37 engages the stop shoulder 34 allowing the shackle to rotated. However, the slide portion 38 of the shackle is still received through the yoke hole 49, and the retaining cable 45 cannot be removed (FIG. 8).

Figure 9:
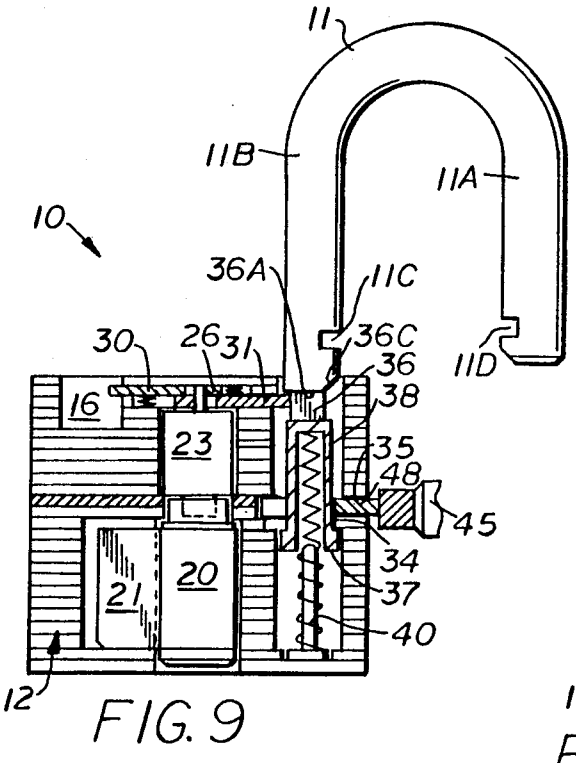
FIG. 9 is longitudinal cross section showing the shackle rotated 180 degrees with the retaining cable yoke maintained within the lock case on the shackle.
Figure 7:
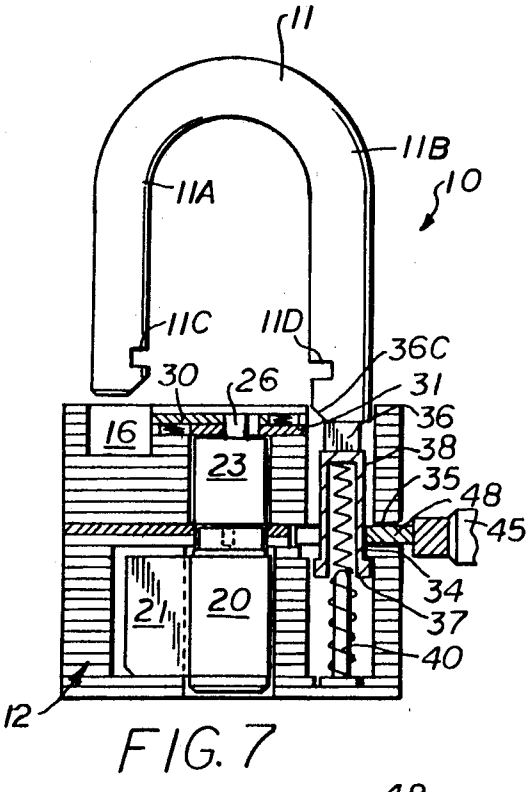
FIG. 7 longitudinal cross section showing the lock device in the unlocked position with the retaining cable yoke maintain the lock case on the shackle.

As seen in FIG. 9, the shackle is rotated 180 degrees and the retaining cable yoke 48 is still locked within the lock case 12 because the slide portion 38 of the shackle 11 is still received through the yoke hole 49 and urged upward by the spring 40. The configuration of the tapered surface 36C and shoulder 36A is such that the shackle 11 will be prevented from moving downward past the locking plate 31 when the shackle is rotated 180 degrees and the locking plates have been extended by releasing the key 25. In other words, the shackle 11 can not be pushed down unless the key is inserted and turned to retract the locking plates 30 and 31, or unless the shackle is turned to position the toe-piece 11A in axial alignment with the bore 16 and the shackle 11 is pushed down to the locked position. In the position shown in FIG. 9, the lock 10 is unlocked and can be installed on or removed from the article to be secured by the lock but the retaining cable can not be removed.

Figure 10:
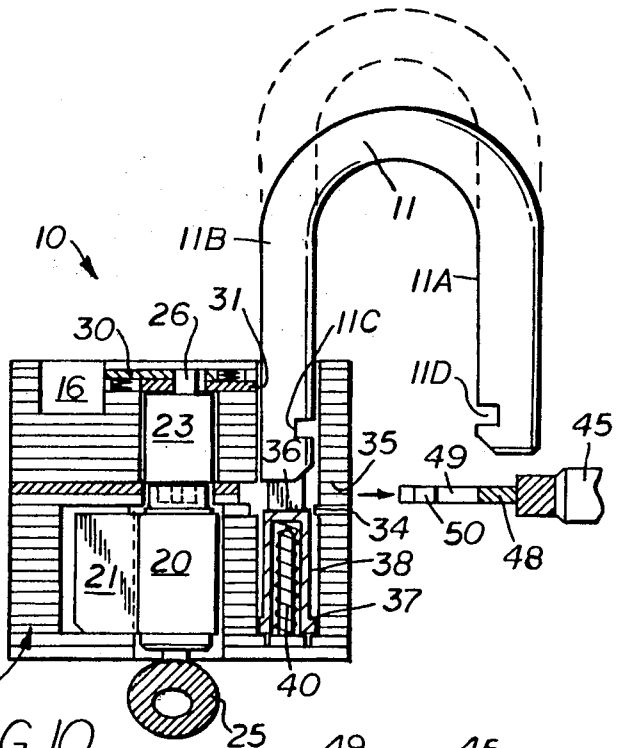
FIG. 10 is longitudinal cross section showing the shackle pressed down after being rotated 180 degrees with the retaining cable yoke being removed from the lock case and shackle.
Figure 11:
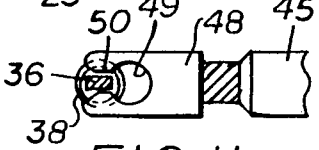
FIG. 11 is transverse cross section showing the retaining cable yoke being removed from the release portion of the shackle.

However, as shown in FIG. 10, when the shackle is rotated 180 degrees and the key is inserted and turned to retract the locking plates 30 and 31, the shackle 11 can be pushed to the complete down position whereby the flat release portion 36 is received in the yoke hole 49 and the yoke 48 can be pulled out of the lock case 12.

Thus, the retaining cable allows the lock device to be retained at the use location whether the shackle is in a locked or unlocked condition and aids in preventing the lock from being lost or stolen.

While this invention has been described fully and completely with special emphasis upon a preferred embodiment, it should be understood that within the scope of the appended claims the invention may be practiced otherwise than as specifically described herein.

I claim:

1. A lock device comprising:

a lock case having side walls and top and bottom walls and apertured to receive the heel-piece and toe-piece of a shackle and one end of a retaining cable, a shackle having a heel-piece at one end reciprocally and rotatably retained within one of said case apertures and a toe-piece at another end reciprocally received and retained in another one of said case apertures and being movable between locked and unlocked positions and a release position, locking means within said lock case for engagement with said shackle to selectively lock said shackle heel-piece and toe-piece within said case, a retaining cable having one end removably received in another said case aperture and engaged with said shackle to selectively lock said one end within said case and having another end adapted to be secured to objects for maintaining the lock device at a selected location, said retaining cable one end being locked within said case with said shackle in its locked and unlocked position and selectively disengaged from said shackle and removed from said case upon manipulation of said shackle to its release position.

2. A lock device according to claim 1 in which;

said shackle is a generally U-shaped configuration with said heel-piece being at the end of a longer leg thereof and said toe-piece being at the end of a shorter leg thereof.

3. A lock device according to claim 1 in which;

said case is formed of a plurality of layers of thin rectangular plates secured together stacked relation, and said case apertures are created by the alignment of apertures formed in individual plates when said plates are stacked.

4. A lock device according to claim 1 in which;

said case apertures include a pair of laterally spaced bores extending inwardly from said top wall one of which receives said shackle heel-piece and the other of which receives said shackle toe-piece.

5. A lock device according to claim 4 including a stop shoulder in said shackle receiving bore of said case, and a corresponding shoulder on said shackle heel-piece to reciprocally and rotatably retain said shackle within said bore.

6. A lock device according to claim 1 including resilient means in said case operatively connected to said shackle heel-piece for urging said shackle upward in the unlocked position such that said shackle toe-piece is raised out of said aperture and said shackle may be rotated about the axis of the heel-piece.

7. A lock device according to claim 1 in which;

said locking means comprises a key cylinder assembly having a rotatable mechanism operated by a key and a pair of laterally movable members operatively connected thereto which extend laterally to engage said shackle heel-piece and toe-piece in the locked position and retract therefrom in the unlocked position upon rotation of the key.

8. A lock device according to claim 7 in which;

said shackle heel-piece and toe-piece each having a notch on opposed sides, and said laterally movable members are operatively connected to said key cylinder to engage said shackle heel-piece and toe-piece notches in the locked position and retract therefrom in the unlocked position upon rotation of the key.

9. A lock device according to claim 7 in which;

said case apertures include a horizontal slot extending through one side wall and terminating at said aperture which receives said shackle heel-piece, said retaining cable on end having a yoke configuration slidably received through said slot and being apertured to be received on said shackle heel-piece, and said shackle heel-piece having a portion of its length received through said yoke to prevent lateral movement of said yoke when said shackle is raised and rotated relative to said case between the locked and unlocked positions and a portion of its length thereabove configured to correspond with said yoke aperture for allowing it to be removed laterally from said slot only when the key is rotated to the unlocked position and said shackle is rotated and pressed downward to the release position.

10. A lock device according to claim 9 in which said retaining cable another end has a mounting member secured thereon which is apertured such that said yoke may be passed therethrough to form a loop for securing the lock device to a convenient structure in close proximity to where the lock device will be used.

11. A lock device according to claim 9 in which said retaining cable another end has a mounting member secured thereon which is apertured to receive mounting hardware for securing the lock device to a convenient structure in close proximity to where the lock device will be used.

12. A lock device according to claim 1 in which said retaining cable is formed of flexible cable.

13. A lock device according to claim 12 in which said flexible cable has a protective sheath formed of weather resistive material.

14. A lock device according to claim 1 in which said lock case has at least one colored portion, and said retaining cable is colored to match the colored portion of said lock case for identifying certain lock devices to be connected to certain retaining cables at predetermined locations.

15. A lock device according to claim 14 in which said lock case colored portion comprises a colored stripe surrounding said case.

16. A lock device according to claim 14 in which said lock case colored portion comprises a colored band of resilient material surrounding said case and the outer periphery thereof raised from the case surface to additionally serves as a resilient bumper to prevent said lock case from damaging the surface upon which it is locked or retained by said retaining cable.

17. A lock device according to claim 14 including a key for operating said locking means, said key having at least one colored portion matching the colored portion of said lock case and said retaining cable for identifying a particular key that operates certain lock devices to be connected to certain retaining cables at predetermined locations.

18. A lock device according to claim 17 in which said key has a plurality of differently colored portions matching the colored portion of a plurality of said lock cases and said retaining cables for identifying a particular key that operates certain ones of said lock devices to be connected at predetermined locations.

19. A lock device according to claim 17 in which said key colored portion comprises one or more colored inserts secured thereon.

* * * * *